United States Patent [19]

Haeberle

[11] 4,087,826

[45] May 2, 1978

[54] PULSED ELECTRICAL PRINTER WITH DIELECTRICALLY ISOLATED ELECTRODE

[75] Inventor: Robert W. Haeberle, Acton, Mass.

[73] Assignee: EPP Corp., Boston, Mass.

[21] Appl. No.: 710,892

[22] Filed: Aug. 2, 1976

[51] Int. Cl.[2] ..... G03G 15/048

[52] U.S. Cl. ..... 346/155; 346/159

[58] Field of Search ..... 346/153, 155, 165, 154, 346/159

[56] References Cited

U.S. PATENT DOCUMENTS

| | | | |
|---|---|---|---|
| 3,124,804 | 3/1964 | Johnson | 346/155 |
| 3,380,070 | 4/1968 | Betts | 346/155 |
| 3,550,153 | 12/1970 | Haeberle | 346/165 |
| 3,898,674 | 8/1975 | Koch | 346/155 |
| 3,946,402 | 3/1976 | Lunde | 346/153 |
| 3,964,388 | 6/1976 | Maxwell | 346/153 |

*Primary Examiner*—Jay P. Lucas

*Attorney, Agent, or Firm*—Kenway & Jenney

[57] ABSTRACT

A non-impact printer for transferring printing particles from a donor sheet to a recipient sheet by applying pulses to produce an electrical field between a print electrode and a base electrode. The print electrode comprises a conductive member having a field shaping surface corresponding in shape to an image to be printed. The electric field passes through dielectric material between the field shaping surface and the donor and recipient sheets, the dielectric material being chosen for its stability against breakdown in high electric fields.

9 Claims, 2 Drawing Figures

26
38

30
32
PLASTIC
24
56
36
48
34
53
22
18
PAPER
20
54
27
16
14
28
12

26
38

30
46
PLASTIC
40
56
58
50
36
60
42
64
44
53
22
18
62
PAPER
20
66
54
27
16
14
28
12

PULSED ELECTRICAL PRINTER WITH DIELECTRICALLY ISOLATED ELECTRODE

RELATED APPLICATIONS

This application has been assigned to the same assignee as copending applications Ser. No. 710,282 entitled "Inks for Pulsed Electrical Printing and Methods of Producing Same," Ser. No. 710,280 entitled "Magnetic Inking Apparatus for Pulsed Electrical Printing," Ser. No. 710,281 entitled "Non-Impact Printer With Magnetic Ink Reorientation," and Ser. No. 710,283 entitled "Structured Donor Sheet for High-Resolution Non-Impact Printer," all filed on July 30, 1976, and incorporates the disclosures thereof by reference as hereinafter specifically noted.

BRIEF SUMMARY OF THE INVENTION

This invention relates generally to apparatus for pulsed electrical printing, as contrasted to mechanical impact and electrostatic printers. Mechanical printers deliver ink to a recipient sheet by mechanical movement from a supply or donor sheet or strip. Electrostatic printers generally employ multi-step procedures involving sequential selective charging of surfaces and transfer of toner particles by electrostatic attraction. The present invention relates more directly to printers of the general type described in the U.S. patent to Robert W. Haeberle, et al U.S. Pat. No. 3,550,153 dated Dec. 22, 1970. The printing process of said patent consists generally in providing an electrically conductive ink, a receiving or recipient paper or sheet, and means for producing an electric field of a predetermined shape to be printed, in pulses between the ink and paper. In a typical application this field may be in the order of 1000 volts across a gap of between 5 and 10 mils, this gap being measured from the ink through the thickness of the receiving sheet to the pulsed field shaping electrode. The ink or pigment is in mobile, particulate form. During the presence of the electric field, the ink particles on pinnacles are first charged by conduction of current from other particles closer to a supporting sheet, detached by the electric field, and then caused to transfer to the receiving paper by the force induced solely by the electric field. As described in said patent, the particles of conductive ink are initially deposited upon a surface of an ink support described as a donor sheet. In general, the amplitude and duration of the electric pulses must be so related as to cause an efficient transfer of sufficient ink for the required printing density, without causing an electrical breakdown or discharge between the electrodes.

A principal object of this invention is to provide improved pulsed electrical printers having means for the prevention of such electrical breakdowns or discharges, thereby permitting the use of higher electrical potentials than those hitherto used.

Another and related object is to provide means for the prevention of electrical breakdown or discharge in conjunction with shield electrodes, thereby making possible the use of higher voltages to compensate for the tendency of shield electrodes to reduce the available electrical potential for transferring printing particles.

As described in said patent, the surface of the donor sheet closest to the recipient sheet includes electrically conductive particles of a printing material dispersed in a high resistance medium. The pulsed electrical field is applied to charge the printing particles selectively. The charged particles are subsequently transferred to the adjacent surface of the recipient sheet under the influence of the applied field. This is an efficient charging technique, whereby a charge is imparted to the printing particles in a very brief space of time. Because these conductive printing particles are dispersed in a high resistance medium, the electric field lines of the applied field become concentrated upon the conductive particles; thus these field lines tend to avoid the high resistance medium separating the conductive particles. The concentration of the field lines is a consequence of the concentration of induced charge upon these particles, and in addition it represents a focusing of lines of force upon the charged particles. The force on a particle depends on the electric field strength at the particle and the charge on the particle, being proportional to the product of the charge and the field strength. Both factors are increased when charge accumulates on a conductive particle, since the gathering of charge is accompanied by an increase in the density of field lines, which means an increase in the field strength, measured in lines per unit area.

In printers of the type described in said patent, the donor sheet contains a non-homogeneous distribution of conductive particles in a poorly conducting medium, a depth distribution with groups of particles in mounds or towers. A printing pulse will charge preferentially those particles in preferred locations, such as the summits of mounds or towers, and these particles will be subjected to strong forces tending to detach them from their neighbors and transfer them from the donor sheet to the recipient sheet. In the practice of the printing technique described in said patent, the high resistance medium need not be a solid material, and in some cases it can be air. That is, if the donor sheet is properly constructed and inked, in such a way that the conductive pigmented particles are arranged in mounds and towers, the air surrounding and separating these mounds and towers can play the role of the poorly conducting medium in which the conductive particles are dispersed.

A donor sheet for non-impact printing, in which the poorly conducting medium is a solid dielectric composite material, is described in U.S. Pat. No. 3,833,409 to John Peshin, dated Sept. 3, 1974. This donor sheet is described as having a high lateral resistivity to aid in confining the printing to the immediate vicinity of the printing electrode face.

A further improvement upon the printing apparatus of said U.S. Pat. No. 3,550,153 is described in U.S. Pat. No. 3,898,674 to Paul L. Koch, dated Aug. 5, 1975. This patent describes a shield electrode that confines the printing field distribution more narrowly than would be possible with an unshielded printing electrode. It has been found that with the printing field distribution thus confined, satisfactory high resolution printing is obtained with a conductive base or support for the pigment particles, provided that the structure of the base or support and the arrangement of the pigment particles thereon are such as to produce a partial isolation of the conductive pigment particles into mounds and towers that are separated by a poorly conducting medium such as air or a suitable solid material.

When the base material of the donor sheet is conductive, the hazard of electrical breakdown during the printing pulse is increased. A feature of the present invention is the reduction of this hazard by the provision of a covering of dielectric material over the field shaping surface of the print electrode. In one embodiment, the latter electrode is recessed within a volume enclosed by a shield electrode, with the remainder of this volume being substantially filled by a dielectric material capable of withstanding the high electric fields which are generated by the printing pulses, without breakdown.

The use of dielectric material chosen for its stability against breakdown in high electric fields for covering the printing electrode has been found to improve the operation of pulsed electrical printers, particularly when printing pulses are applied in the form of a bipolar sequence of square or rounded pulses. In the use of oscillatory printing waveforms, the succession of pulses of opposite polarity, which are of sufficient magnitude to produce some air ionization, tend to produce accumulations of electric charge upon the outer surface of the electrode-covering dielectric material, but since these charges are of alternating polarity they tend to cancel one another, thereby tending to reduce the net accumulation of electric charge upon the latter surface.

The use of an electrode-covering dielectric material has utility in printers wherein the printing electrode is not shielded, as described in said U.S. Pat. No. 3,550,153. In such printers the dielectric material prevents air breakdown at the surface of the printing electrode during a printing pulse. It will be understood that the electric field is particularly strong in the close vicinity of the sharp edges on the field-defining surface of the print electrode. Preferably, the protective dielectric material covers these sharp edges and keeps the surrounding air from coming close thereto. Thus air is precluded from those locations having the strongest electric field concentrations where electrical breakdowns in the air might otherwise be produced.

DETAILED DESCRIPTION

Figure 1:
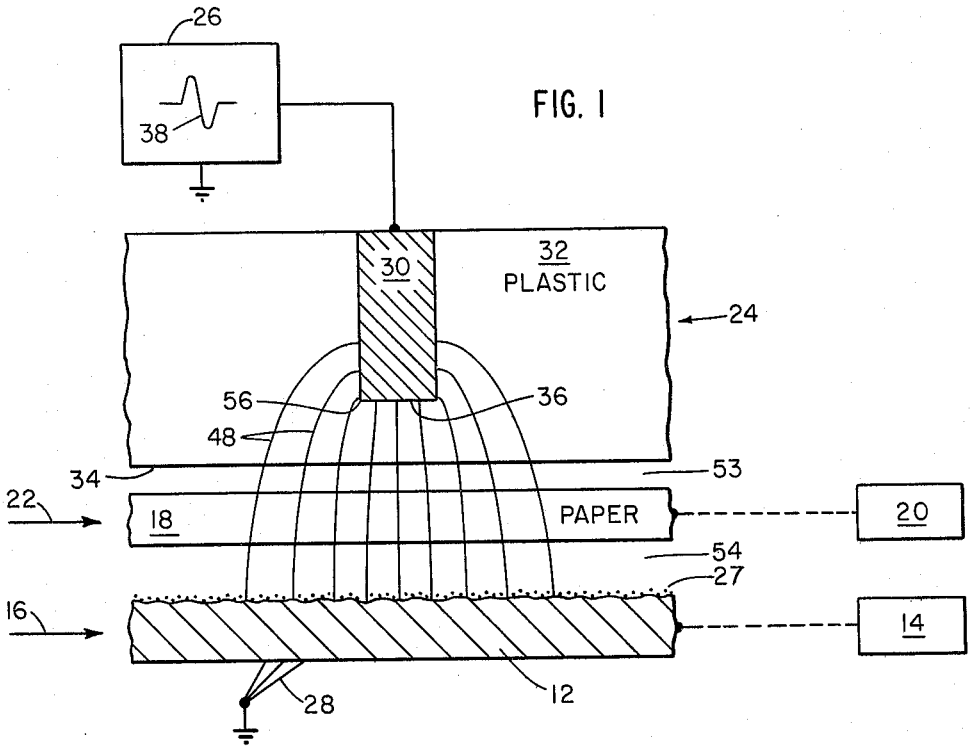
FIG. 1 is a cross section of pulsed electrical printing apparatus embodying the invention.
Figure 2:
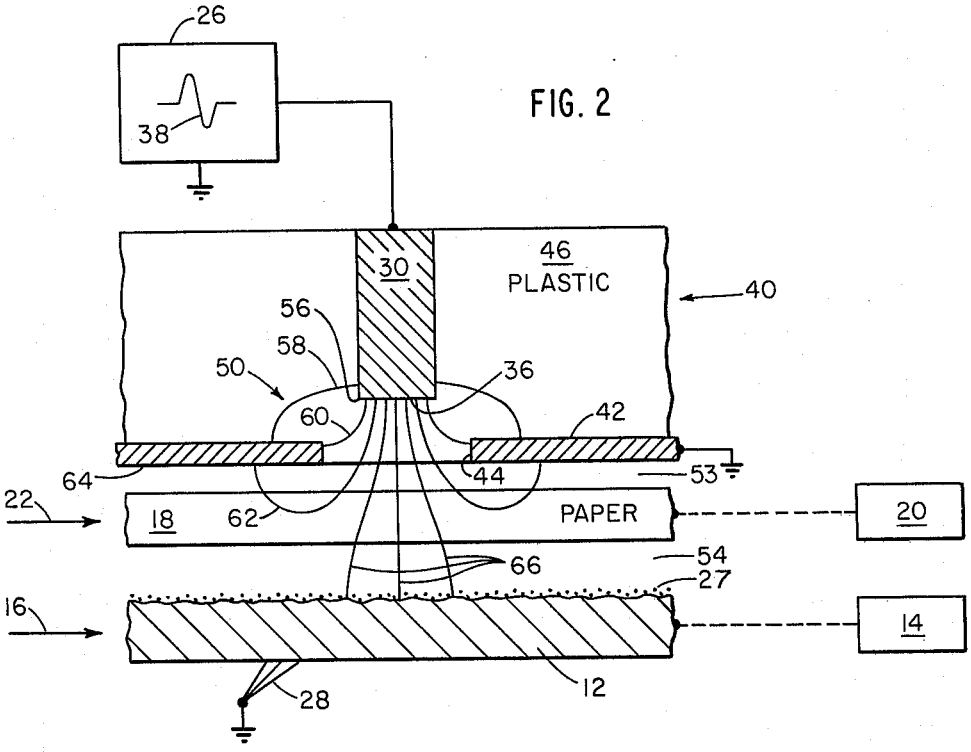
FIG. 2 is a cross section of a variant of the embodiment of FIG. 1 including a shield electrode.

FIGS. 1 and 2 illustrate diagrammatically the major elements of a pulsed electrical printer embodying the invention. The printer may be adapted to use an expendable donor sheet or a donor sheet having a continuous surface adapted to pass between a reinking station and a printing station as described in said application Ser. No. 710,280 entitled "Magnetic Inking Apparatus for Pulsed Electrical Printing." The printer includes a donor sheet 12, drive means 14 for moving the donor sheet in the direction of an arrow 16, a recipient sheet 18, drive means 20 for moving the recipient sheet in the direction of an arrow 22 and preferably at the same speed as the sheet 12, a print electrode designated generally as 24, and a source 26 of print pulses. For purposes of illustration, the donor sheet is shown as comprising a metal belt as described in the last mentioned application, having a roughened or microcavernous surface upon which are deposited printing particles 27 as mutually separated mounds or towers. The source 26 is connected between a brush 28 making contact with the belt 12, identified as ground, and a metallic field shaping electrode member 30. The member 30 is embedded in a body 32 of dielectric material such as glass, a plastic consisting of a polyimide sold by E. I. du Pont de Nemours & Co. under the name Kapton, or any other suitable material.

It will be understood that if desired, the donor sheet or belt 12 may consist of a dielectric material or one having relativley poor conductivity, as described in said U.S. Pat. No. 3,550,153 or said U.S. Pat. No. 3,833,409. In that case, a base electrode is situated on the side of the donor sheet opposite to the print electrode 24 and connected with ground. Other forms of donor sheet may also be used, as described in said application Ser. No. 710,283, entitled "Structured Donor Sheet for High-Resolution Printer." The recipient sheet 18 is preferably plain, uncoated paper.

The print electrode 24 has a surface 34 that is preferably flat and smooth, thereby resisting any tendency for the accumulation of bits of paper or ink particles, or other dirt accumulations that might influence the quality of the printed image. The member 30 has an end surface 36 facing and spaced from the surface 34, the surface 36 being shaped to correspond to the shape of the electric field during printing, and also the shape of the resulting printed matter. In the drawing, the surface 36 is assumed to be circular and the member 30 is cylindrical, although a great variety of other shapes may be used. The illustrated embodiment is adapted to print a round dot, and is of the electrode design ordinarily employed for facsimile printers and printers for alphanumeric characters by dot-matrix printing, as is well understood in the art. The dielectric material 32 covers the end surface 36 and the contiguous lateral surface of the member 30.

Preferably, the source 26 produces bipolar pulses 38, although the invention is also useful in printers employing unidirectional pulses for printing characters or dots of any shape.

In the embodiment of FIG. 2, like reference numbers have been applied to the elements that are the same as in the embodiment of FIG. 1. However, FIG. 2 shows a printed electrode 40 having a shield electrode 42 comprising a flat sheet of metal having a circular hole 44 therein, the hole being coaxial with the electrode member 30, and the electrode 42 being embedded on a dielectric material 46.

Referring to FIG. 1, the presence of a pulse between the electrode member 30 and the donor sheet or belt 12 produces an electric field represented by lines of electric force 48. The field produced in the embodiment of FIG. 2 is similarly represented by lines 50. In both embodiments the field distributions are shown for the case of a cylindrical electrode member 30. In printers where the member 30 is replaced by a member shaped like an entire letter, number or other character, a different field line distribution may result from each printing pulse, but in any such embodiment there is preferably a portion of the dielectric material 32 that covers the field shaping surface corresponding to the surface 36.

As shown in FIG. 1, an air gap 53 exists between the surface 34 of the print electrode 24 and the recipient sheet 18. Also, an air gap 54 exists between the donor sheet 12 and the recipient sheet 18. These air gaps may be of varying size, and in some cases either or both of the air gaps 53 and 54 may be extremely small.

In FIG. 2, the cylindrical printing electrode 30 is shielded by the grounded shielding window electrode 42, as more fully explained in said U.S. Pat. No. 3,898,674. The volume surrounding the electrode member 30 and bounded in part by the shield window 44 is filled by the dielectric material 46. While either glass or Kapton are the preferred materials for this dielectric material, other materials of equivalent or comparable dielectric properties may be employed.

In the embodiments of both FIG. 1 and FIG. 2, the encapsulation of the printing electrode member 30 protects against electrical breakdown in the presence of high electric fields at the sharp corners such as 56 on the surface 36. Also, in the embodiment of FIG. 2 this encapsulation protects against breakdown at the sharp corners defining the window 44 of the shield electrode 42.

Referring to FIG. 2, certain lines 58 extend from lateral surfaces of the member 30 to a surface of the shield electrode 42. Certain lines 60 extend from the surface 36 of the member 30 to the inner or edge surface of the shield window 44. Certain lines 62 extend from the surface 36 to an outer surface 64 of the shield electrode 42. Certain lines 66 extend from the surface 36 to the donor sheet 12. It will be understood that only the lines 66 represent field lines contributing to the printing of the dot image by the transfer of the particles 27 on to the adjacent surface of the recipient sheet 18.

Thus it can be seen from FIG. 2 that one effect of the grounded window shield 42 is to confine the field lines that reach the donor sheet to a limited portion of the latter, as compared with FIG. 1, for example. Moreover, in the embodiment of FIG. 2 the electric field strength at the donor sheet is substantially weaker than the electric field strength at the surface 36 and corners 56 of the printing electrode. In order that the field strength at the donor sheet should be adequately strong to produce satisfactory printing, the printing pulses 38 must be of sufficiently higher magnitude, and are preferably of the order of 500 to 1400 volts. Typically, this voltage is such that the dielectric material 46 must have a breakdown strength substantially greater than that of air to prevent electrical breakdown of the dielectric, which would interfere with the proper operation of the printer.

It will be understood that certain variations may be made in the above-described electrode structures. Thus the dielectric material 32 may comprise one or more components of dielectric material for ease of manufacture. In embodiments such as FIG. 2 employing a shield electrode 42, the dielectric material 46 is preferably made flush with the outer surface of the shield to prevent the formation of a pocket that could collect paper fibers, ink particles, or other debris that could interfere with the optimal functioning of the printer.

Although the shield electrode 42 has been shown as a sheet having an aperture window, other forms of shield electrodes may be employed, such as those described in said U.S. Pat. No. 3,898,674.

I claim:

1. Apparatus for pulsed electrical printing having, in combination, a print electrode comprising a body of dielectric material having a breakdown strength substantially greater than that of air, said body having a first surface, and a conductive member having a field shaping surface spaced from and facing said first surface and a lateral surface contiguous with the field shaping surface and extending therefrom away from said first surface, said field shaping and lateral surfaces being embedded in said dielectric material, means to put a donor sheet bearing conductive printing particles and a recipient sheet adjacent to and facing said first surface, and means to establish an electrical field of short duration between the particles and said conductive member, said field having sufficient amplitude to establish a current flow which charges said particles and causes them to detach from the donor sheet and move to the recipient sheet, but insufficient magnitude to produce a breakdown of said dielectric material between said first and field shaping surfaces.

2. Apparatus according to claim 1, in which all points on the field shaping surface are substantially equidistant from the first surface.

3. Apparatus according to claim 1, in which the means to establish an electrical field produces bidirectional pulses.

4. Apparatus according to claim 1, in which the print electrode has a conductive shield element having aperture edge portions spaced from and surrounding said field shaping surface.

5. Apparatus according to claim 4, in which the shield element has portions imbedded in the dielectric material.

6. Apparatus according to claim 5, in which the shield element is of sheet form and has a surface substantially flush with and defining said first surface of the dielectric material.

7. Apparatus according to claim 6, in which substantially all points on the field shaping surface are substantially equidistant from said aperture edge portions of the shield element.

8. Apparatus according to claim 1, in which the dielectric material is glass.

9. Apparatus according to claim 1, in which the dielectric is Kapton.

* * * * *